US006201352B1

(12) United States Patent
Ge et al.

(10) Patent No.: US 6,201,352 B1
(45) Date of Patent: Mar. 13, 2001

(54) COLD CATHODE FLUORESCENT DISPLAY

(75) Inventors: Xiaoqin Ge, Qiu Zhi Zong (CN); Shichao Ge, San Jose, CA (US); Yuanyue Zhang, Guangzhou (CN)

(73) Assignee: GL Displays, Inc., Saratoga, CA (US)

( * ) Notice: Subject to any disclaimer, the term of this patent is extended or adjusted under 35 U.S.C. 154(b) by 0 days.

(21) Appl. No.: 09/187,766

(22) Filed: Nov. 6, 1998

Related U.S. Application Data

(63) Continuation-in-part of application No. 08/532,077, filed on Sep. 22, 1995, now Pat. No. 5,834,889.

(51) Int. Cl.[7] ..... G09G 3/10

(52) U.S. Cl. ..... 315/169.1; 315/177; 315/291; 315/312; 345/102; 345/66

(58) Field of Search ..... 315/160, 167, 315/177, 180, 169.1, 291, 278, 312, DIG. 5; 313/113, 493, 317, 573; 345/66, 102

(56) References Cited

U.S. PATENT DOCUMENTS

| | | | | |
|---|---|---|---|---|
| D. 334,242 | | 3/1993 | Imamura et al. | D26/1 |
| D. 334,990 | | 4/1993 | Sekiguchi et al. | D26/1 |
| 2,171,359 | | 4/1939 | Gertler | 176/1 |
| 4,029,984 | | 6/1977 | Endriz | 313/96 |
| 4,425,608 | | 1/1984 | Hecker et al. | 362/291 |
| 4,558,400 | | 12/1985 | Buser | 362/222 |
| 4,625,152 | | 11/1986 | Nakai | 315/317 |
| 4,731,661 | * | 3/1988 | Nagano | 358/75 |
| 4,750,096 | | 6/1988 | Lim | 362/218 |
| 4,767,193 | | 8/1988 | Ota et al. | 350/345 |
| 4,839,564 | | 6/1989 | Ide et al. | 315/169 |
| 5,019,749 | | 5/1991 | Ito | 315/224 |
| 5,032,765 | | 7/1991 | Nilssen | 315/97 |
| 5,051,648 | * | 9/1991 | Misono et al. | 313/13 |
| 5,061,872 | | 10/1991 | Kukla | 313/111 |
| 5,151,632 | * | 9/1992 | Troxell | 315/169.1 |
| 5,191,259 | | 3/1993 | Hayashi et al. | 313/497 |
| 5,216,324 | | 6/1993 | Curtin | 313/495 |
| 5,220,249 | | 6/1993 | Tsukada | 315/246 |
| 5,334,068 | | 8/1994 | Stewart et al. | 345/88 |
| 5,347,292 | * | 9/1994 | Ge et al. | 345/74 |
| 5,387,837 | | 2/1995 | Roelevink et al. | 313/484 |
| 5,455,484 | | 10/1995 | Maya et al. | 315/58 |
| 5,457,312 | | 10/1995 | Mansour | 250/222.2 |
| 5,461,397 | * | 10/1995 | Zhang et al. | 345/102 |
| 5,466,990 | | 11/1995 | Winsor | 315/56 |
| 5,502,626 | | 3/1996 | Armstrong et al. | 362/216 |
| 5,514,934 | | 5/1996 | Matsumoto et al. | 313/607 |
| 5,659,224 | * | 8/1997 | Kumar et al. | 313/310 |
| 5,834,889 | * | 11/1998 | Ge | 313/493 |
| 5,900,700 | * | 5/1999 | Arndt et al. | 315/291 |

FOREIGN PATENT DOCUMENTS

| | | |
|---|---|---|
| 1123945 | 6/1996 | (CN) . |
| 95116709 | 3/1997 | (CN) . |

(List continued on next page.)

OTHER PUBLICATIONS

"S11–3 Study to Improve the Flood–Beam CRT for Giant Screen Display," M. Morikawa et al., *Japan Display '92,* 1992, pp. 385–388.

(List continued on next page.)

*Primary Examiner*—Haissa Philogene
(74) *Attorney, Agent, or Firm*—Skjerven Morrill MacPherson LLP

(57) ABSTRACT

A monochromic, multi-color and full-color cold cathode fluorescent display (CFD), comprises of: some shaped white or multi-color or red, green, blue three primary color cold cathode fluorescent lamps (CCFL), reflector, base plate, temperature control means, luminance and contrast enhancement face plate, shades and its driving electronics. CFD is a large screen display device which has high luminance, high efficiency, long lifetime, high contrast and excellent color. CFD can be used for applications both of outdoor and indoor even at direct sunlight, to display character, graphic and video image.

54 Claims, 10 Drawing Sheets

FOREIGN PATENT DOCUMENTS

| | | |
|---|---|---|
| 0213560 | 3/1987 | (EP) . |
| 0331660 | 9/1989 | (EP) . |
| 0348979 | 1/1990 | (EP) . |
| 0593311 | 4/1994 | (EP) . |
| 0151850 | 8/1995 | (EP) . |
| 0840353 | 5/1998 | (EP) . |
| 1383653 | 2/1975 | (GB) . |
| 1485166 | 9/1977 | (GB) . |
| 2261332 | 5/1993 | (GB) . |
| 60-041750 | 3/1985 | (JP) . |
| 62-157657 | 7/1987 | (JP) . |
| 01315787 | 12/1989 | (JP) . |
| 3-264990 | 11/1991 | (JP) . |
| 7-043680 | 2/1995 | (JP) . |
| 7-114904 | 5/1995 | (JP) . |
| 9-092210 | 4/1997 | (JP) . |
| WO9429895 | 12/1994 | (WO) . |
| 9522835 | 8/1995 | (WO) . |
| 9738410 | 10/1997 | (WO) . |

OTHER PUBLICATIONS

"8.2: A High–Resolution High–Brightness Color Video Display for Outdoor Use," N. Shirmatsu et al., *SID 89 Digest,* 1989, pp. 102–105.

"28.5: Large Area Color Display Skypix," Y. Sakaguchi et al., *SID 91 Digest,* 1991, pp. 577–579.

* cited by examiner

COLD CATHODE FLUORESCENT DISPLAY

CROSS REFERENCE TO RELATED APPLICATION

This application is a continuation-in-part of application Ser. No. 08/532,077, filed on Sep. 22, 1995, now U.S. Pat. No. 5,834,889.

BACKGROUND OF THE INVENTION

1. Field of the Invention

This invention relates in general to a cold cathode fluorescent display (CFD) and in particular, to a high luminance, high efficiency, long lifetime, monochrome or multi-color or full-color ultra-large screen display device, which can display character, graphic and video image for both indoor and outdoor applications.

2. Description of the Prior Art

The major prior technologies for ultra-large screen display are as follows:

A. Incandescent Lamp Display:

The display screen consists of a lot of incandescent lamps. The white lamps are always used for displaying the white and black characters and graphics. The color incandescent lamps, which use red, green, and blue (R, G, B) color glass bubbles, are used for displaying multi-color or full-color character, graphic and image. The incandescent lamp display has been widely used for outdoor character and graphic displays and possesses certain advantages such as high luminance, functionable at direct sunlight with shade and low cost of lamps. Nevertheless, this technology suffers from the following disadvantages: low luminous efficiency (i.e., white lamp about 10–12 lm/W; R, G, B≦⅓ of white); high power consumption; poor reliability, unexpected lamp failure; short lifetime; expensive maintenance cost; long response time and unsuitable for video display.

B. LED:

LED has been widely used for indoor large screen and ultra-large screen display, to display multi-color and full-color character, graphic and video images. This display is able to generate high luminance for indoor applications and can maintain a long operation lifetime at indoor display luminance level. The disadvantages of LED, however, are as follows: low luminous efficiency and high power consumption especially for the ultra-large screen display; low luminance for outdoor application especially the wide viewing angle is required or at direct sunlight; expensive, especially for ultra-large screen display because the need of a lot of LEDs; and lower lifetime at high luminance level.

C. CRT:

CRT includes Flood-Beam CRT (e.g., Japan Display '92, p. 385, 1992), and matrix flat CRT (e.g., Sony's Jumbotron as disclosed in U.S. Pat. No. 5,191,259) and Mitsubishi's matrix flat CRT (e.g. SID '89 Digest, p. 102, 1989). The CRT display is generally known for its ability to produce good color compatible with color CRT. The disadvantages of CRT are as follows: low luminance for outdoor applications; low contrast at high ambient illumination operating condition; short lifetime at high luminance operating condition; expensive display device due to complex structure and high anode voltage about 10 kv.

D. Hot Cathode Fluorescent Display:

Hot cathode fluorescent technology has been used in a display system called "Skypix" (SED '91 Digest, p. 577, 1991) which is able to generate a high luminance about 5000 cd/m$^2$ and can be operated at direct sunlight. The disadvantages of this system are: low luminous efficiency due to hot cathode and short gas discharge arc length; very high power consumption and short lifetime because hot cathode and too many switching times for video display.

At present, the incandescent lamps are commonly used for outdoor character and graphic displays.

The matrix flat CRT, including flood beam CRT and matrix CRT, is the most common display for outdoor video display. Neither of these two technologies presents a display system which can be used in both indoor and outdoor applications possessing unique features overcoming all or substantially all of the disadvantages described above.

SUMMARY OF THE INVENTION

The present invention has been made in view of the foregoing disadvantages of the prior art.

Accordingly, it is an object of the present invention to provide a very high luminance large screen and ultra-large screen display using a shaped cold cathode fluorescent lamp ("CCFL") preferably with a special reflector and luminance enhancement face plate etc. It can be used for both of indoor and outdoor applications even at direct sunlight. The dot luminance of the character and graphic display can be up to 15,000 cd/m$^2$ or more. The area average luminance of the full-color image can be up to 5000 cd/m$^2$ or more.

It is another object of the present invention to provide a long lifetime large screen and ultra-large screen displays. The lifetime can be up to 20,000 hours or more at high luminance operating condition.

It is one more object of the present invention to provide a high luminous efficiency, low power consumption large screen and ultra-large screen displays. The luminance efficiency can be up to 65 lm/W or more.

It is a further object of the present invention to provide a high contrast large screen and ultra-large screen display preferably with the appropriate shades, black base plate and luminance and contrast enhancement face plate.

It is still a further object of the present invention to provide a good temperature characteristics large screen and ultra-large screen displays with a temperature control means. The CFD of the present invention can be used for both indoor and outdoor applications, and any ambient temperature condition.

In accordance with the invention, a cold cathode fluorescent display device is provided which includes a number of individually controllable cold cathode fluorescent lamps and means for applying operating voltages to the lamps to control the fluorescence of the lamps in order to display a character, graphics or a video image. The above-referenced individually controllable cold cathode fluorescent lamps may be used in a display method where a character, graphics, or video image may be displayed by applying operating electrical signals to the lamps to control time periods during which the lamps fluoresce.

In according with the preferred embodiment of the present invention, there is provided a CFD including some shaped R, G, B CCFLs, and with R, G, B filters, reflectors, base plate, luminance and contrast enhancement face plate, temperature control means, and its driving electronics. To control the lighting period or lamp current or ON/OFF of CCFLs according to the image signal, to control the luminance of CCFLs to display the character, graphic and image with monochrome, multi-color or full-color.

BRIEF DESCRIPTION OF THE DRAWINGS

Other objects and many of the attendant advantages of the present invention will be readily appreciated as the same becomes better understood by reference to the following detailed description when considered in connection with the accompanying drawings, wherein:

FIG. 1(*b*) is a partial side cross-sectional view of the device in FIG. 1(*a*).

FIG. 8(*b*) is a timing diagram to illustrate the operation of the circuit of FIG. 8(*a*).

FIG. 10(*b*) is a timing diagram to illustrate the operation of the circuit of FIG. 10(*a*).

FIG. 11(*b*) is a timing diagram to illustrate the operation of the circuit of FIG. 11(*a*).

FIGS. 11(*c*), 11(*d*) and 11(*e*) are schematic circuit diagrams to illustrate a driving circuit of CCFLs lamps in a CFD.

DETAILED DESCRIPTION OF THE PREFERRED EMBODIMENTS

Now, a CFD according to the present invention will be described with reference to the accompanying drawings.

A cold cathode fluorescent lamp normally has two electrodes, both located inside a tube which contains mercury and some inert gas such as neon, argon or helium. The cold cathode fluorescent lamp functions in the glow gas discharge region. It operates at high voltage (of the order of several hundred volts), low current (several milliamperes) and at a relatively high temperature (30 to 75° C., optimum at about 60° C., cathode operating in a temperature of about 150 to 190° C.). It has a high efficiency of about 35 to 65 lumens per watt. The excitation of mercury is used to generate ultraviolet light and the ultraviolet light generated by mercury impinges on the fluorescent material on the inside of the tube in order to generate visible light. The inert gas is present in the tube not to generate ultraviolet fight but to impede the movement of mercury atoms and to increase the probability of collision ionization of mercury atoms between the electrodes so as to increase the amount of ultraviolet light generated by mercury atoms during their passage between the two electrodes.

The CFD of the present invention has two types: CCFL assembly type and CCFL lamp type. The CFD of the present invention can be a single piece structure or a mosaic structure. For the ultra-large screen CFD, it is always made in a mosaic type, i.e., the display screen is assembled by some mosaic tiles.

Figure 1B:
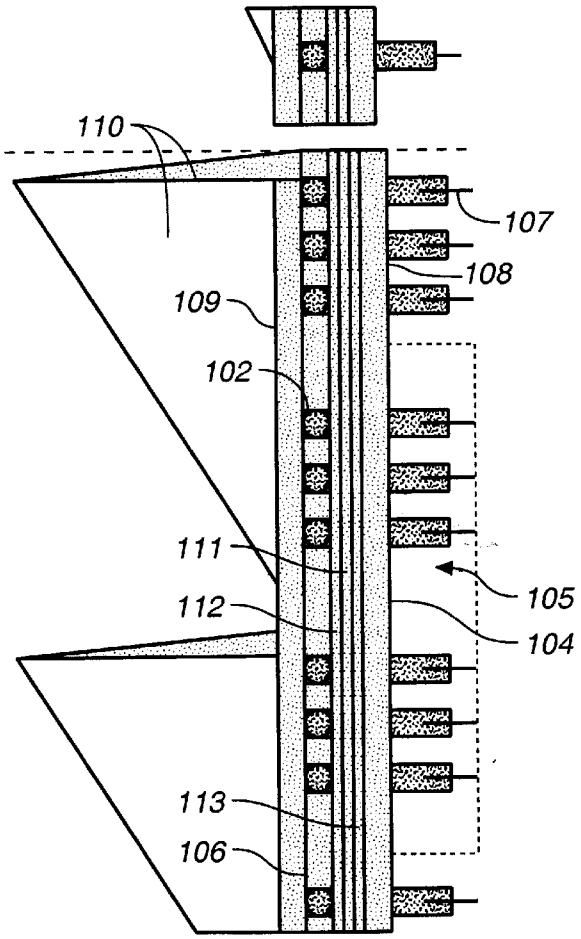
FIG. 1 shows a mosaic CCFL assembly type CFD and FIG. 1(*a*) is a partial top view of the mosaic CFD to illustrate the preferred embodiment of the present invention.
Figure 1A:
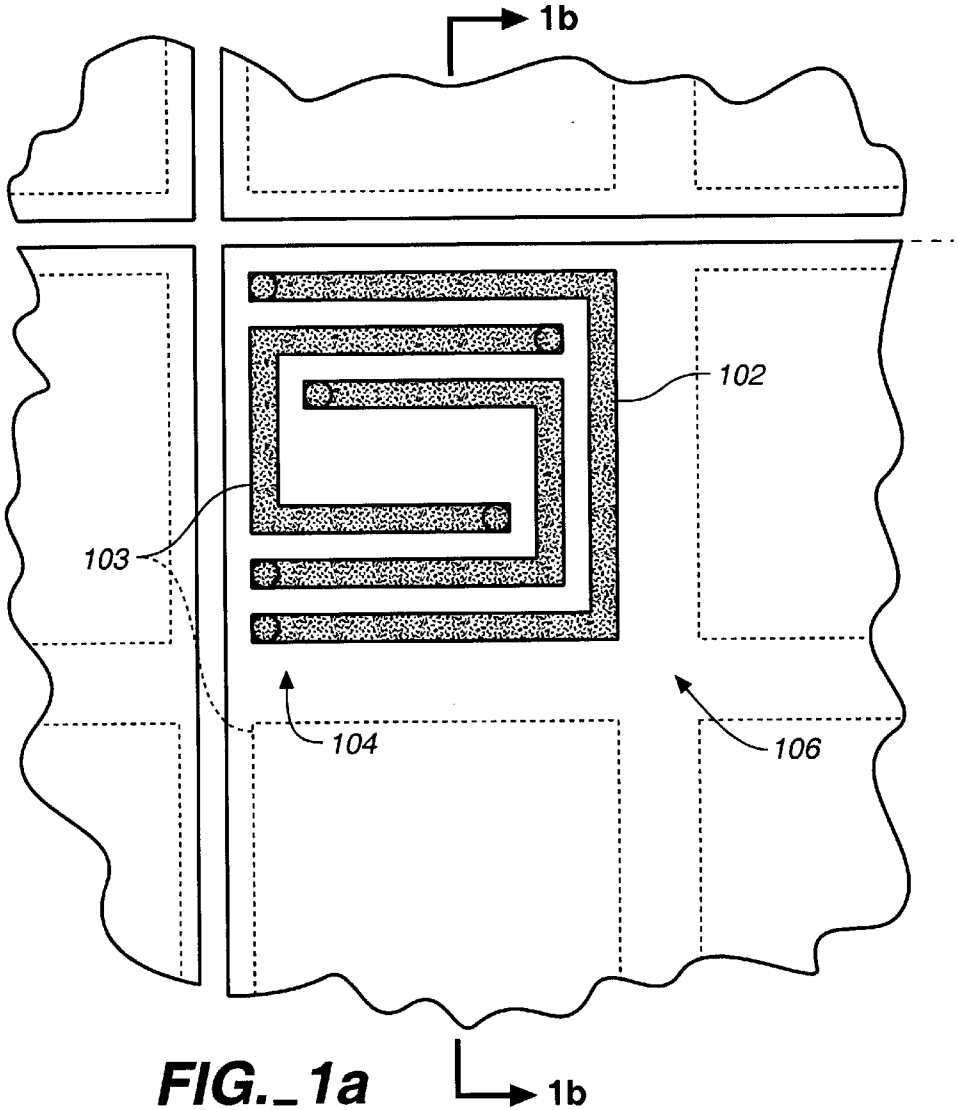

FIG. 1 shows a mosaic CCFL assembly type CDF wherein FIG. 1(*a*) shows a partial top view of a preferred embodiment of the mosaic CFD provided by the present invention and FIG. 1(*b*) further shows a partial side-view of FIG. 1(*a*). 101 is a partial sectional view of a four (4) mosaic CFD tiles. The mosaic CFD tile includes shaped CCFLs 102, which can emit white or R, G and B light. FIG. 1(*a*) is an embodiment of R, G and B full-color CFD. 103 is a pixel which comprises three shaped R, G and B color CCFLs. Generally, although not shown here, one or more pixels are combined together to form a module and one or more modules together to form a display screen to display full-color character, graphic and video images. The R, G and B color CCFLs may be respectively equipped with R, G and B filters whose functions are to absorb the variegated light emitted from gas discharge of the CCFLs to increase color purity, to improve the quality of display images and to increase the contrast of display image by absorbing the ambient incident light. Alternatively, the R, G and B CCFLs are made of R, G and B color glass tubes to absorb the variegated light emitted from gas discharge of CCFLs, to increase the color purity and to absorb the ambient incident light to increase the contrast of display image.

The shape of CCFL can be a "U" shape, or a serpentine, circular or other shapes. For the white or monochromic display, the pixels can be one shaped CCFL or two or more different color CCFLs. 104 is the base plate for the installation of CCFLs 102, its driver 105 and other parts described below. 106 is a black non-reflective surface between CCFLs 102 and the base plate 104 to absorb the ambient incident light and to increase contrast of display image. 107 are the electrode terminals of CCFLs 102, said electrode terminals 107 are bent towards the back of the base plate 104 and are connected to the drivers 105. 108 is a reflector. 109 is a luminance and contrast enhancement face plate. 110 is the black shade to absorb the ambient incident light, including sunlight, to increase the contrast of display image. 111 is a heating and temperature control means seated between CCFL 102 and base plate 104, and close to CCFL 102 to make the CCFL operating at an optimum temperature, e.g., 30° C. to 75° C., to guarantee the luminance and color uniform of the display image and to get the high luminous efficiency, high luminance, and to start fast the display system at any ambient temperature. The heating and temperature control means 111 has a heat conductive plate 112. One mosaic tile may have one or several pieces of the heat conductive plate 112 to ensure that all CCFLs are operated at the same optimum temperature. Between the heating and temperature control means 111 and base plate 104, there is a heat preservation layer 113 to decrease the heat loss and to decrease the power consumption.

Figure 2:
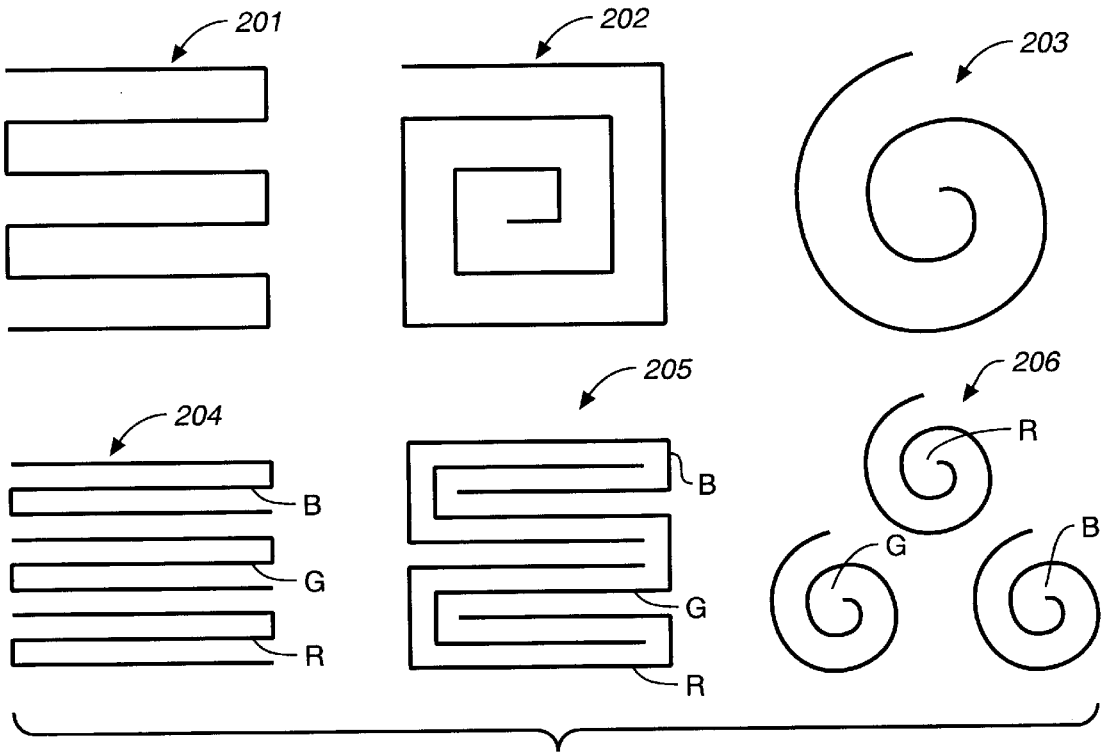
FIG. 2 shows some shape examples of CCFL.

FIG. 2 shows some examples of the possible shapes of the shaped CCFL 102. The shapes of 201, 202, and 203 are for the white or monochromic display, and 204, 205 and 206 are for multi-color and full-color displays.

Figure 3A:
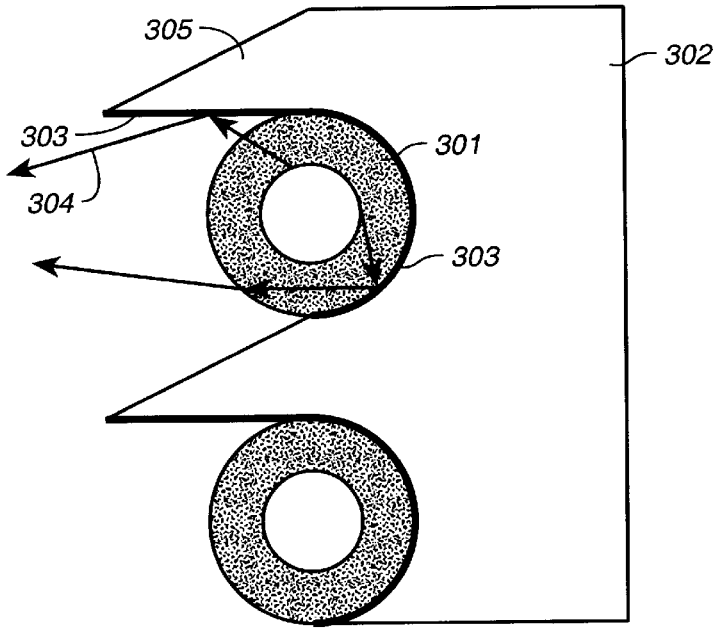
FIG. 3*a* and 3*b* is a partial cross-sectional of the reflector and the CCFL.
Figure 3B:
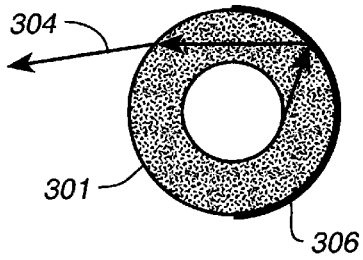

FIGS. 3(*a*) and (*b*) are the cross-sectional views of two kinds of reflectors and CCFL for CCFL assembly type CFD as shown in FIG. 1. 301 is the CCFL. 302 is the base plate. 303 is the reflector which is made of a high reflectance layer, e.g., Al or Ag or other alloy film, or a high reflectance diffusing surface, e.g., white paint. The reflector 303 is used for reflecting the light emitted from CCFL forward to viewers shown as 304. 305 are a plurality of small shades seated between CCFLs to absorb the ambient incident light to increase the contrast of display image. In FIG. 3*b*, the reflector 306 is made of a high reflectance film, e.g., Al or Ag or alloy film, deposited on the back surface of the CCFL.

Figure 4:
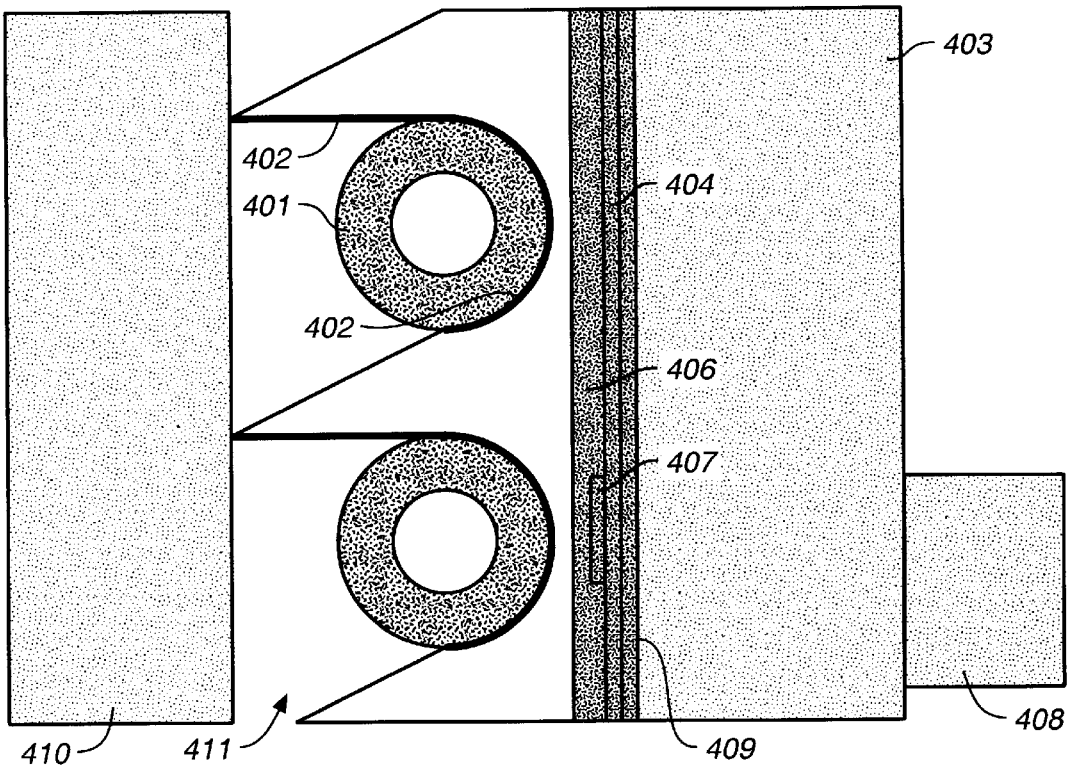
FIG. 4 is an embodiment of the heating and temperature control means.

FIG. 4 shows an embodiment of the heating and temperature control means. 401 is a CCFL. 402 is a reflector. 403 is the base plate. 404 is a heating means, e.g., it is made of an electric heating wire 405 or an electric heating film. 406 is a heat conductive plate and each mosaic tile has one or more heat conductive plate 406 to ensure that all CCFLs are operated at the same optimum temperature. 407 is a temperature sensor and 408 an automatic temperature control circuit. 409 is a heat insulating layer whose function is to decrease the heat loss and decrease the power consumption. 410 is a luminance and contrast enhancement face plate. The chamber between the face plate 410 and heat insulating layer 409 is a heat preservation chamber 411. The temperature of the chamber is controlled at an optimum operating temperature of CCFL, e.g, 30° C. to 75° C.

The said heating means 404 can simply be a heated air flow. The heated air flows through the whole screen between the face plate an the base plate. Some temperature sensors and control circuits to detect and control the temperature of the CCFL chamber.

Figure 5:
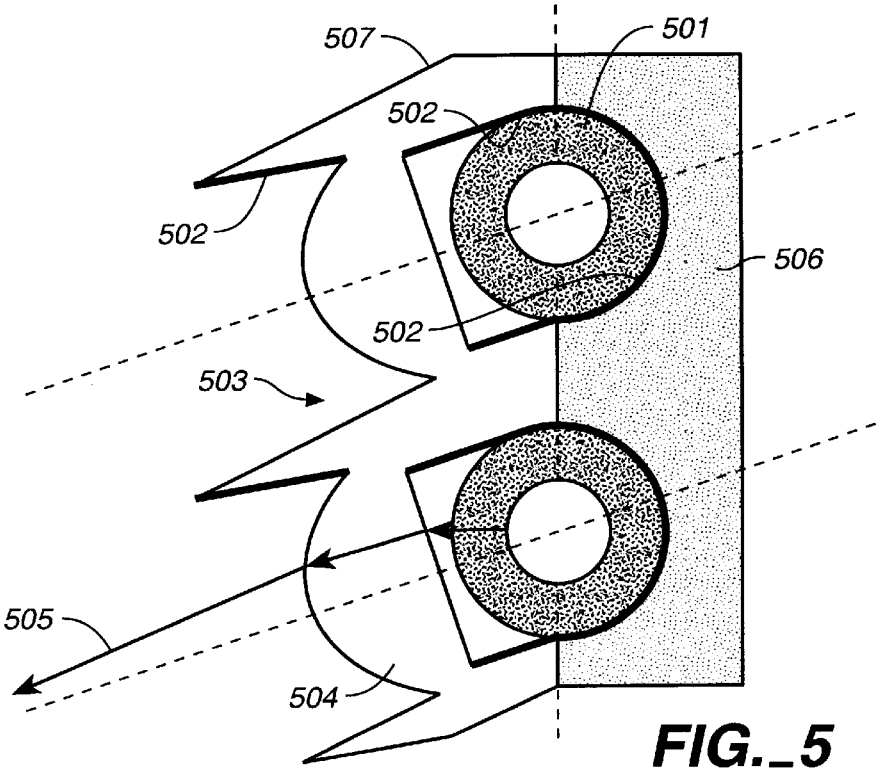
FIG. 5 is a cross-sectional view of an embodiment of luminance and contrast enhancement face plate.

FIG. 5 is a cross-section view of an embodiment of the luminance and contrast enhancement face plate. 501 is the CCFL. 502 is the reflector. 503 is the luminance and contrast enhancement face plate, which consists of a cylinder lens or lens array 504 and the small shades 507. The optical axis of the lens is directed towards the viewers. The light emitted from the CCFL can effectively go through the reflector 502 and becomes focused on the lens 504 to a viewer 505 and thus, increase the luminance of display image and the effective luminous efficiency. 506 is the base plate. 507 is a small shade seated at top of the CCFL to absorb ambient incident light, including sunlight, to increase the contrast of display image.

Figure 6:
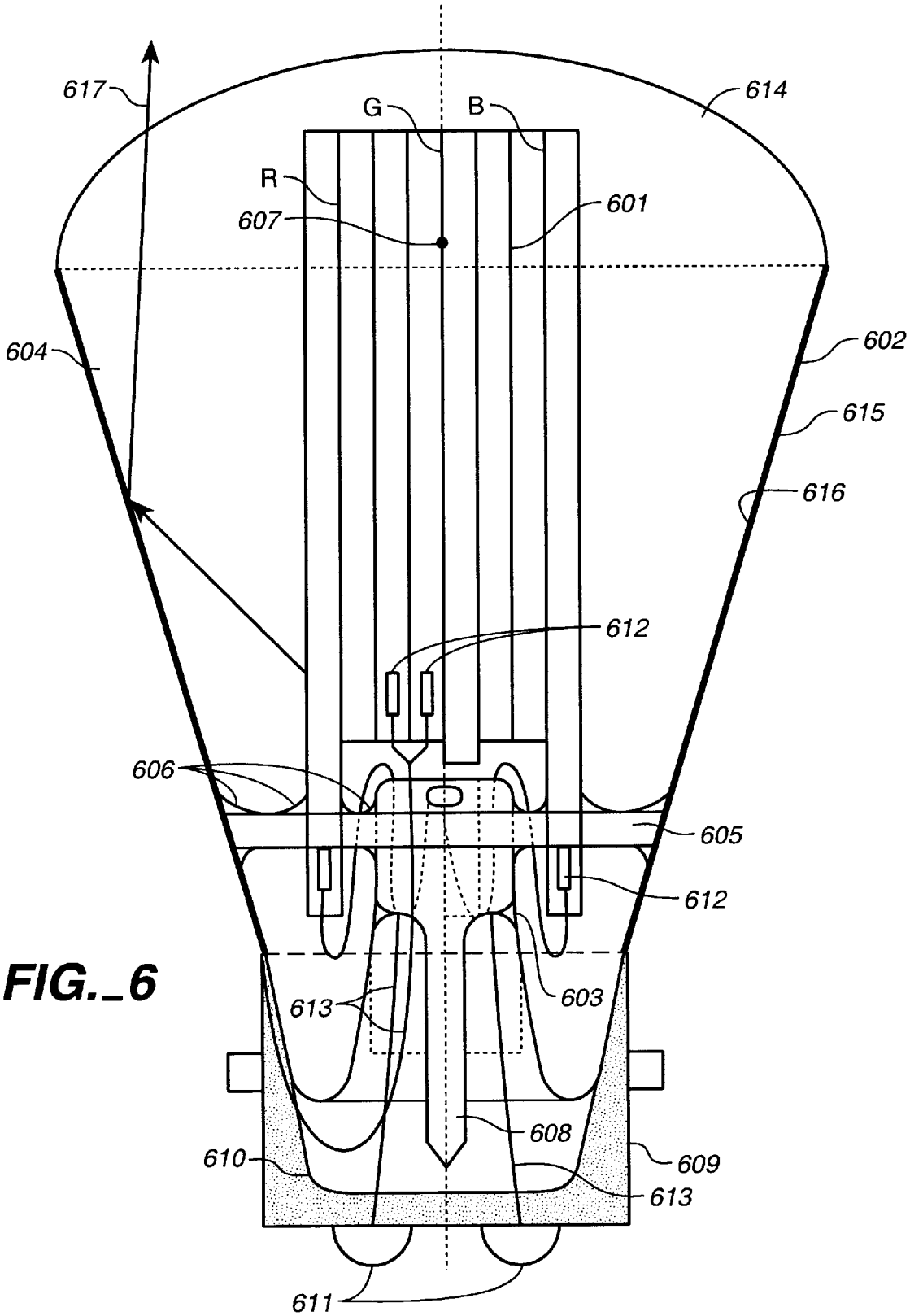
FIG. 6 shows the structure of a luminescent element of a CCFL lamp type CFD.

FIG. 6 shows luminescent elements of a CCFL lamp type CFD. 601 is the CCFL. For the monochrome or white/black displays, 601 is at least one shaped white or monochrome CCFL. For the multi-color display, 601 is at least one group multi-color CCFL. For the full-color display, 601 is at least one group of R, G, B three primary color CCFL as shown in FIG. 6. 602 is a glass tube. 603 is a lamp base which is sealed within the glass tube 602 to form a vacuum chamber 604. 605 is a base plate on which the CCFLs are fixed. The base plate 605 is fixed on the lamp base 603 and its two ends are fixedly connected to the internal surface of the glass tube 602. To obtain a good fixing effect, a vacuum adhesive 606 such as ceramic adhesive is applied between/among the base plate 605, the glass tube 602, the lamp base 603 and the CCFLs. If the CCFL is more than one piece between the CCFLs, these CCFLs are also fixed to each other by a vacuum adhesive 607. 608 is an exhaustion tube for exhausting the gas in the chamber 604. 609 is a lamp head which is fixed to the lamp base by a fixing adhesive 610. 611 are connectors of the lamp. 612 are electrodes of the CCFLs which are connected to the connector 611 and the lamp head 609 through lead 613. The glass tube 602 can be a diffusing glass tube to obtain a diffusing light. Alternatively, the glass tube 602 as the one shown in FIG. 6 in which the glass tube 602 has a front face 614 and a backside 615. The front face 614 is a transparent or a diffusing spherical surface and the backside 615 is a cone shape or a near cone shape tube. On the internal surface of the backside 615 of the glass tube, there is a reflective film 616, e.g., an Al, Ag, or alloy thin film, to reflect the light and to increase the luminance of the lamp shown as 617. The vacuum chamber 604 can reduce the heat loss of the CCFL and hence increase the efficiency of the CCFL. In addition, the vacuum chamber 604 can also eliminate any undesirable effects caused by the ambient temperature to the characteristics of CCFL. The base plate 605 is a high reflective plate to reflect the light and to increase the luminance of the CFD. Some of the CCFL lamps shown in FIG. 6 can be used for making the monochromic, multi-color, full-color display system to display character, graphic or video images. The CCFL lamps can be also used for the purposes of illumination.

Instead of enclosing the CCFL within a vacuum chamber 604, the CCFL may be enclosed within a chamber filled with a gas such as an inert gas or air, which may also be adequate to reduce heat dissipation from the CCFL and to maintain the temperature of the CCFL within an optimal operating temperature range. In other words, instead of evacuating chamber 604, it is possible for chamber 604 not to be evacuated and simply filled with an inert gas or air. Where chamber 604 contains air, sealing of the chamber is not required which simplifies the manufacture of the device.

Figure 7:
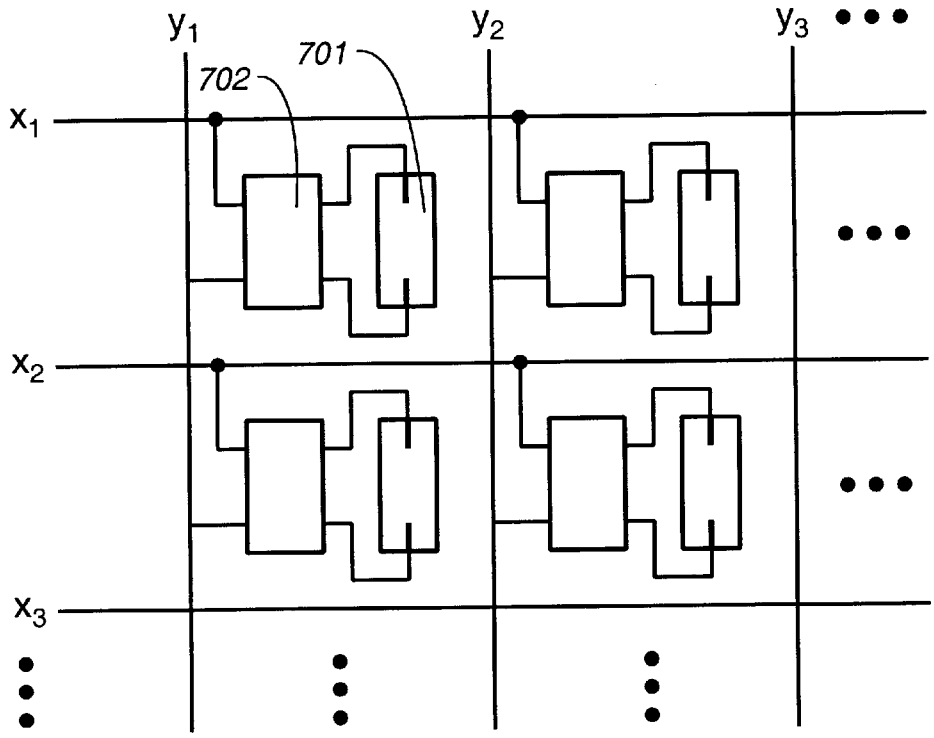
FIG. 7 is a schematic driving circuit diagram of CFD.

Referring now to FIG. 7, the driving circuit of CFD is schematically diagramed. 701 are the CCFLs. 702 are DC/AC converters which change the DC input voltage to a high voltage and high frequency (e.g., tens kHz,) AC voltage to drive the CCFL. The symbols $x_1$, $x_2$ . . . are scanning lines. The symbols $y_1$, $y_2$ . . . are column data electrodes. One DC/AC converter 702 drive one CCFL 701. To control the period of input voltage of the DC/AC converter 702 according to an image signal, the luminance of CCFL can be controlled and the character, graphic and the image can be displayed.

Figure 8A:
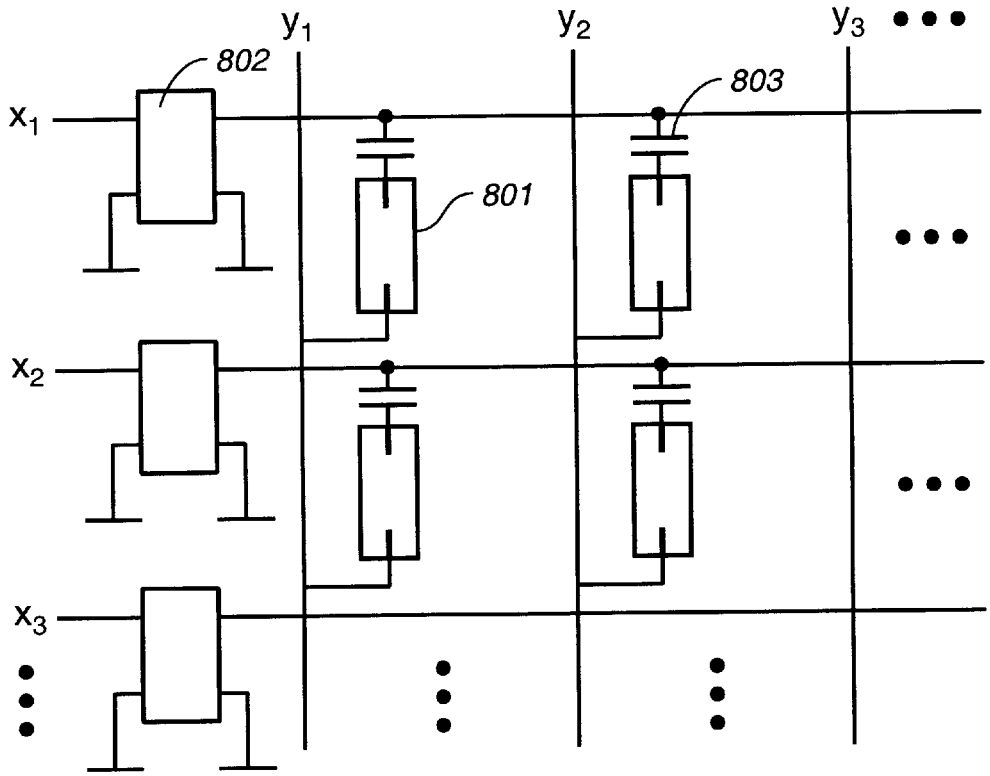
FIG. 8(*a*) is another schematic driving circuit diagram of CFD.
Figure 8B:
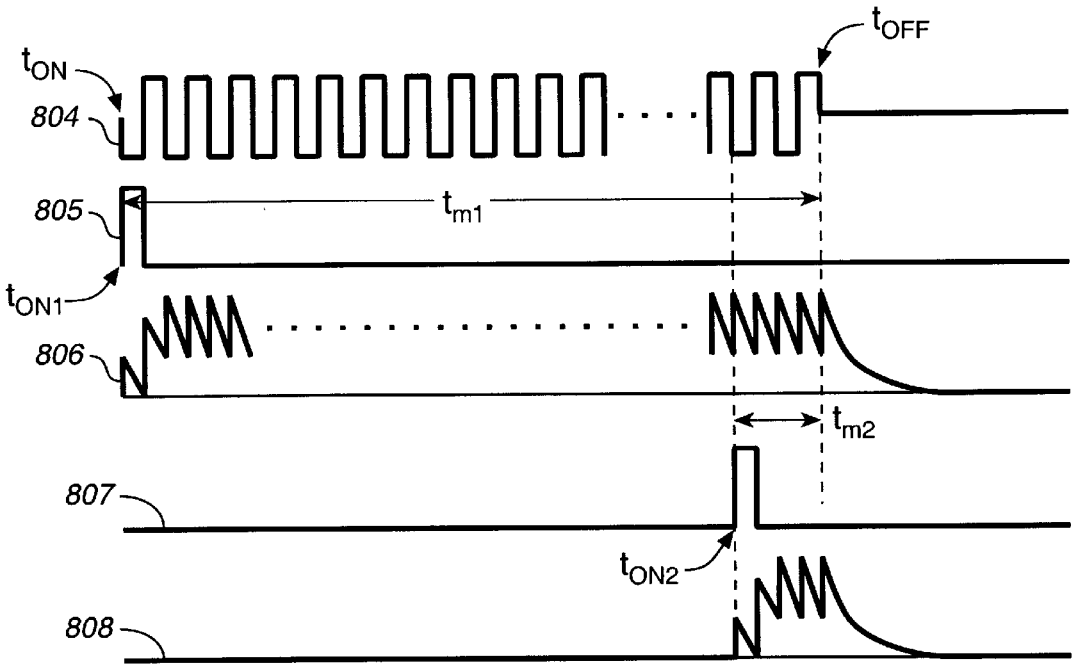

The CFD as illustrated in FIG. 7 will need a lot of DC/AC converters to drive its CCFLs. In order to reduce the number of DC/AC converters and to reduce the cost of the display system, a method which uses one DC/AC converter driving one line of CCFL or one group of CCFL can be adopted as shown in FIG. 8(*a*). FIG. 8(*b*) is a timing diagram to illustrate further the operation of the circuit of FIG. 8(*a*). 801 are the CCFLs. 802 are the DC/AC converters. 803 are coupled capacitors. The symbols $x_1$, $x_2$ . . . are scanning lines. The symbols $y_1$, $y_2$ . . . are column data electrodes. When one scanning line, e.g., $x_1$, is addressed (FIG. 8(*a*), $t_{ON}$), the related DC/AC converter is turned ON to output a sustained AC voltage shown as 804. This sustained voltage is lower than the starting voltage of CCFL, and can not start the CCFLs of this line, but can sustain lighting after CCFL started. Because the starting voltage of CCFL is much larger than the sustained voltage, when the column data electrode ($y_1$, $y_2$ . . .) is at 0 v, the related CCFL can not be started and will stay at OFF state. When the column data electrode supplies an anti-phase trigger voltage, the related CCFL will be started. The CCFL will light until the related DC/AC converter is turned OFF as shown in FIG. 8(*b*) as $t_{OFF}$. The lighting period $t_m$ according to the image signal can be controlled to modulate the luminance of CCFL and to display character, graphic, and image with monochrome or multicolor or full-color. For example, 805 is for a high luminance 806, the lighting period is $t_{m1}$, ($=t_{OFF}-t_{ON1}$), and 807 is for the lower luminance 808, the lighting period is $t_{m2}$ ($=t_{OFF}-t_{ON2}$) and so on.

Figure 9:
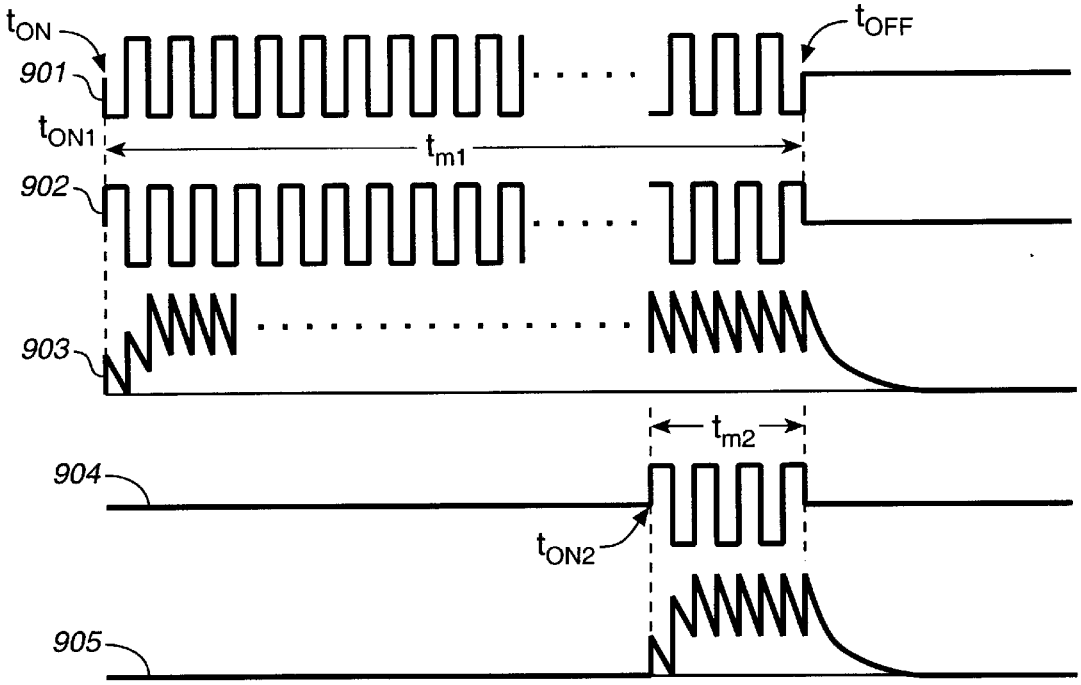
FIG. 9 is a timing diagram to illustrate another operating method of the circuit of FIG. 8(*a*).

FIG. 9 shows a different operating method of the circuit shown in FIG. 8(*a*). 901 is the same as 804 as shown in FIG. 8(*b*) for line scanning. 902 and 904 are the column data voltage, which have an anti-phase with the scanning voltage 901. When a CCFL is applied to the scanning voltage 901 and the signal voltage 902 at the same time, the total voltage applied to the CCFL will be larger than the starting voltage of the CCFL which will light the CCFL in this period. The ON time $t_{m1}$ and $t_{m2}$, i.e., lighting period, are depended on image signals. Different $t_m$ have different lighting periods shown as 903 and 905, i.e., different luminance, to display character, graphic and image.

Figure 10A:
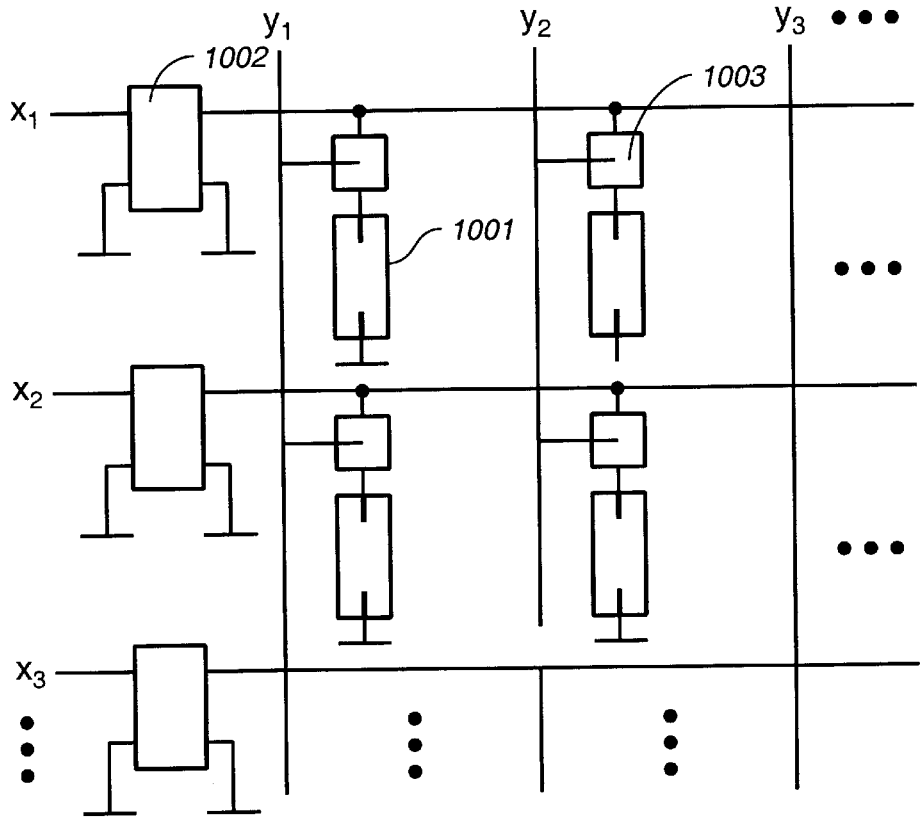
FIG. 10(*a*) is an alternative schematic driving circuit diagram of CFD.
Figure 10B:
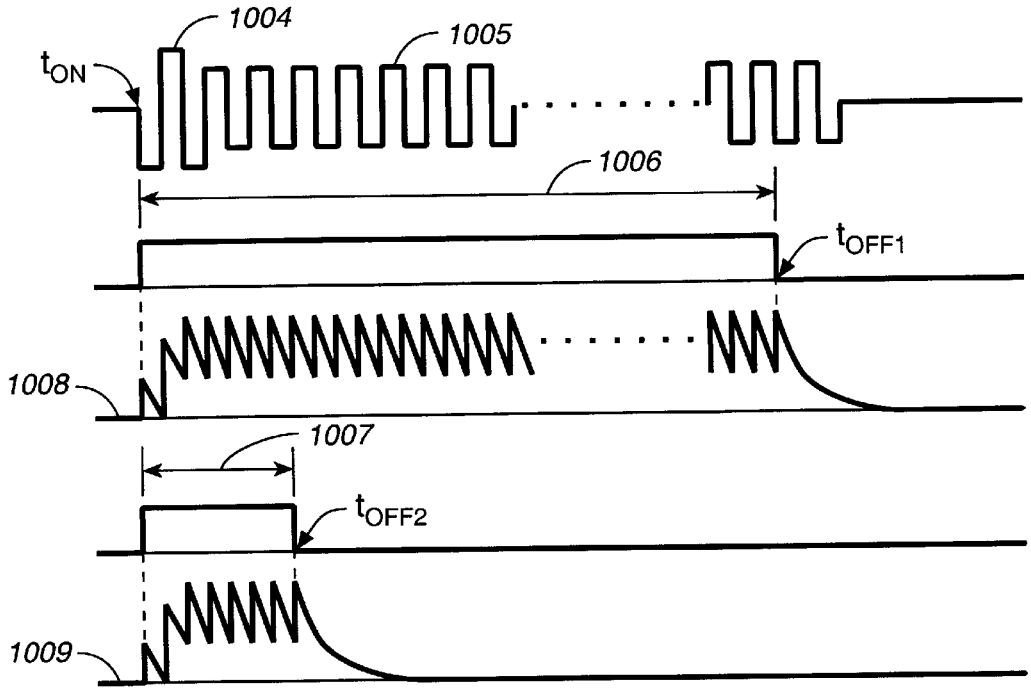

FIG. 10(*a*) is yet another schematic diagram for the driving circuit of CFD. The symbols $x_1$, $x_2$ . . . are the scanning lines. The symbols $y_1$, $y_2$ . . . are the column data electrodes. 1001 are the CCFLs. 1002 are the DC/AC converters. 1003 are AC voltage switches. One line of CCFL or one group of CCFLs has one DC/AC converter 1002. When the switch 1003 is turned ON according to the image signal, the related CCFL will be lighted, and the character, graphic and image can be displayed. In this case, because the starting voltage of CCFL is larger than the sustained voltage, all CCFLs in the same line or same group should start at the same time as shown in FIG. 10(*b*) as $t_{ON}$. At this time, the related DC/AC converter will be turned ON to output a larger voltage 1004, which can start the CCFL. Consequently, all the CCFLs connected with this DC/AC converter are started at this time if the related switch is turned ON. After the CCFL starts, the DC/AC converter will output a lower sustained voltage 1005 to sustain the CCFL lighting. The turn OFF time $t_{OFF}$ of the switch is dependent on the image signal. Since different $t_{OFF}$, e.g., $t_{OFF1}$ and $t_{OFF2}$, can obtain different lighting periods, e.g., 1006 and 1007, different luminance 1008 and 1009 can be obtained to display the character, graphic and image.

FIG. 11(*a*) shows a low AC voltage switch driving circuit. The symbols $x_1$, $x_2$ . . . are scanning lines. The symbols $y_1$, $y_2$ . . . are column data electrodes. 1101 are the CCFLs. 1102 are DC/AC converters, which output a low AC voltage, e.g., several to ten volts and tens kHz. One line of CCFLs or one group of CCFLs has one DC/AC converter. 1103 are low AC voltage switches. 1104 are transformers from which the low AC voltage can be changed to a high AC voltage. 1105 are coupling capacitors. The driving timing diagram is shown in FIG. 11(*b*). 1106 is the low AC voltage output from the DC/AC converter when the line is addressed. 1107 and 1110 are the AC switch control voltages, their widths are dependent on the image signals. 1108 and 1111 are the high AC voltage output from the transformers. 1109 and 1113 are the light waveforms emitted from the CCFLs. When an AC switch is turned ON, the related transformer will output a higher voltage 1114 to start the related CCFL. After the CCFL is started, the transformer output a lower sustained voltage 1115 to sustain the CCFL lighting. When the DC/AC converter 1102 is turned OFF, shown as $t_{OFF}$, all the addressed CCFLs are turned OFF. To control the ON time of the AC switch according to an image signal, the luminance of the CCFL can be modulated to display characters, graphics and images.

CCFLs are operated at high frequencies in the order of tens of kHz and in the range of 900 to 1,500 volts. When the CCFLs are not emitting light, higher voltages need to be applied to cause the lamps to start light emission, where such starting voltages are typically at or near the higher end of the 900 to 1,500 volts range. After the CCFLs have been caused to start emitting light, light emission may be sustained by applying sustaining voltages lower than the starting voltage, typically voltages at or towards the lower end of the range of about 900 to 1,500 volts.

Figure 11A:
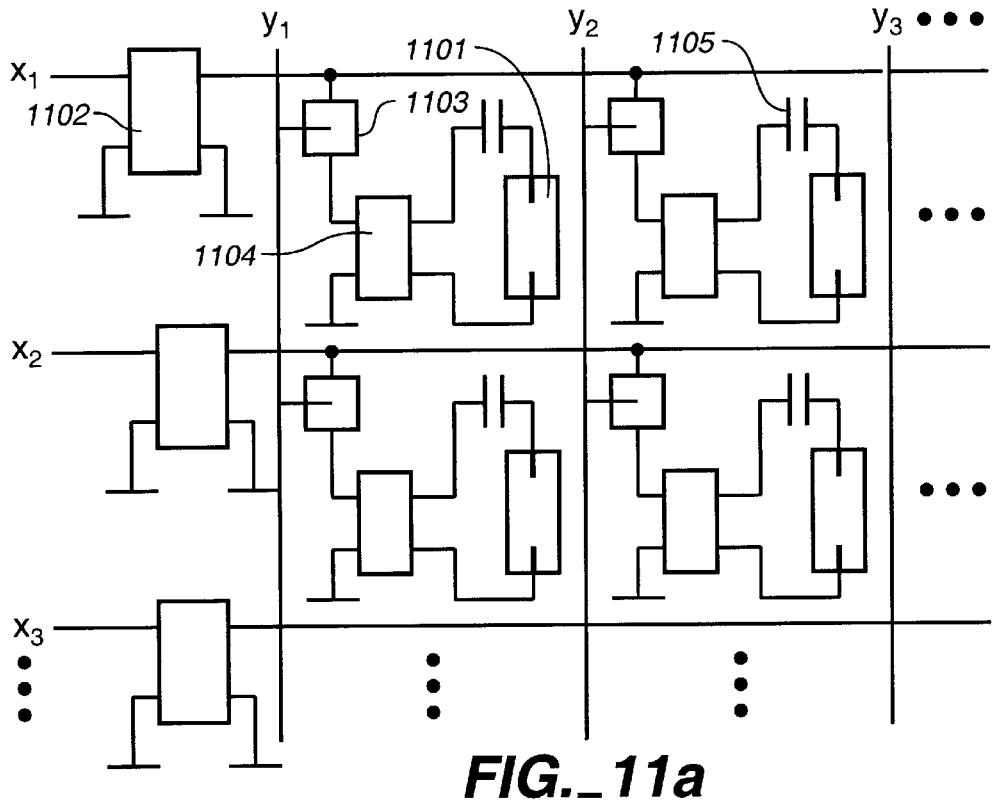
FIG. 11(*a*) is a different schematic driving circuit diagram of CFD.
Figure 11B:
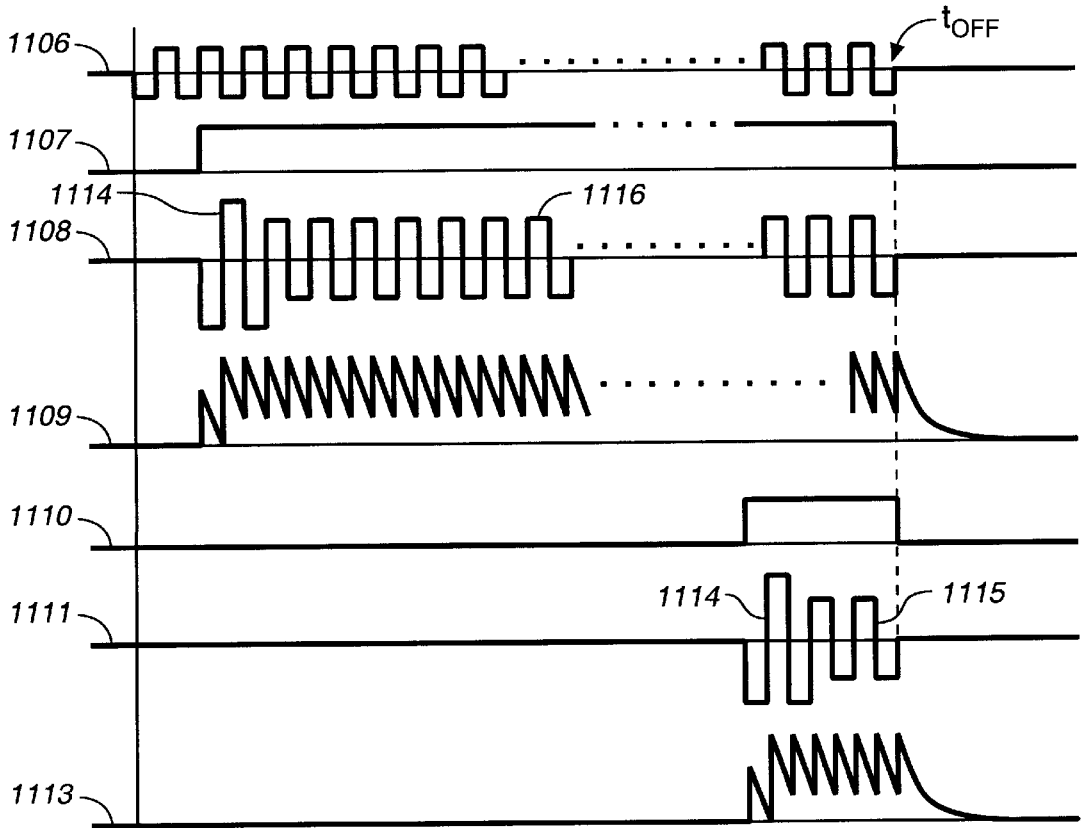
Figure 11C:
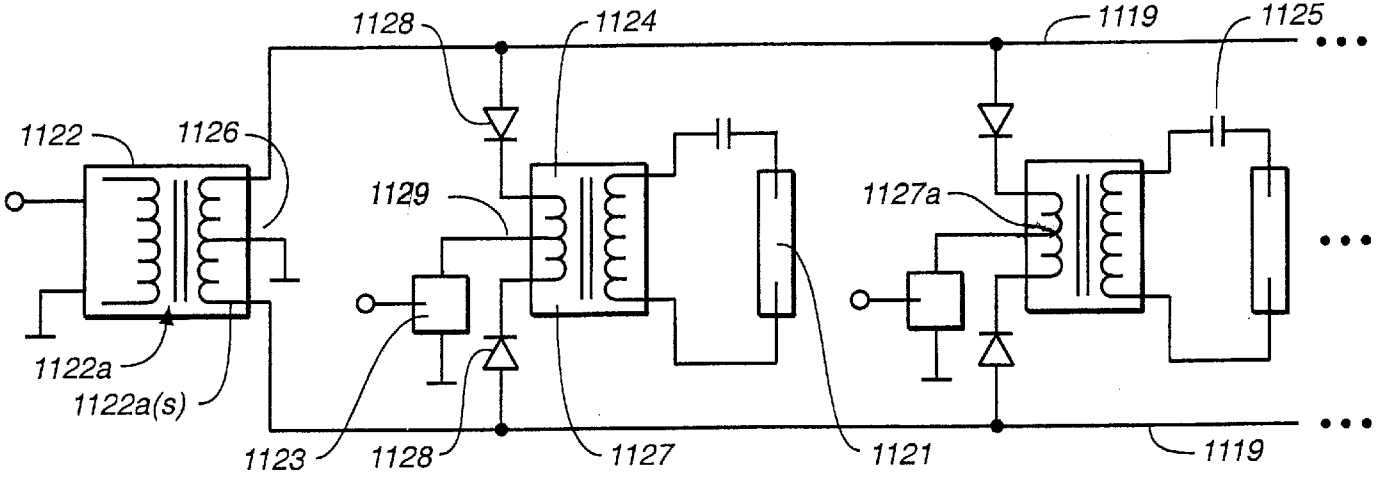
Figure 11D:
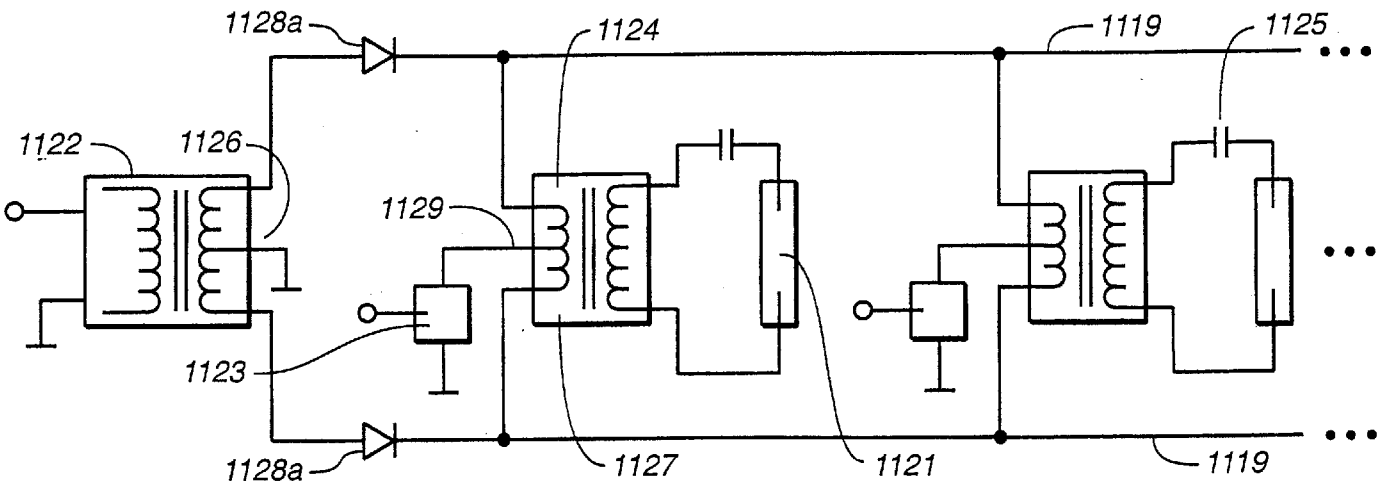
Figure 11E:
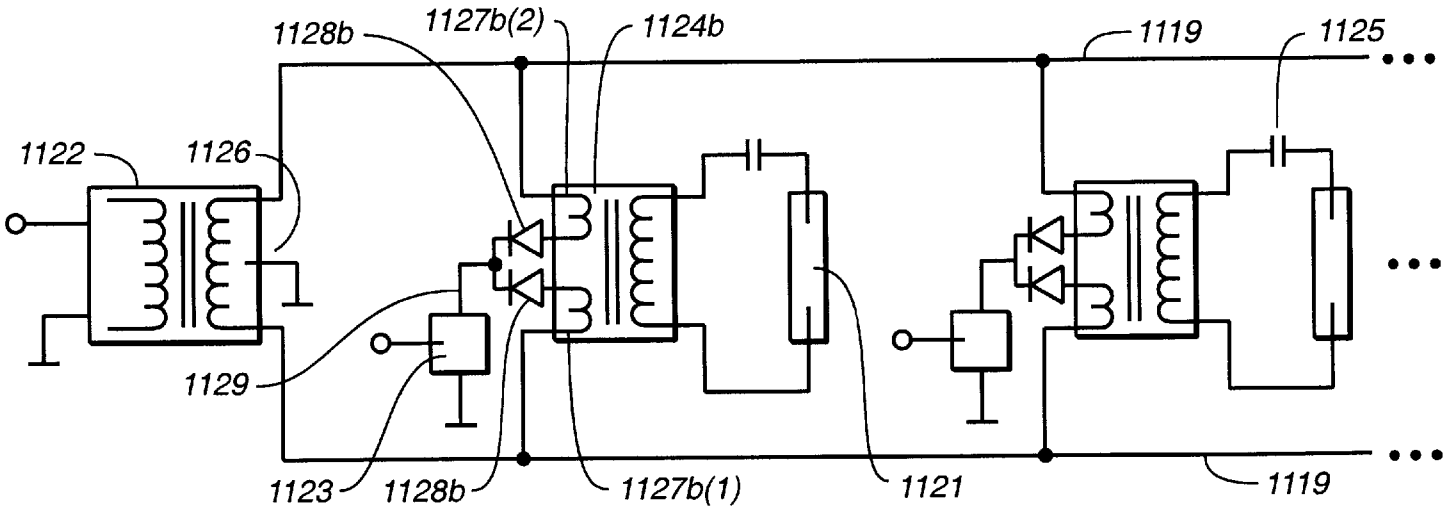

In order for a two-dimensional array of CCFLs, such as those in FIGS. 7, 8*a*, 10*a* and 11*a* to display characters, graphics and images, the lamps must be switched on and off periodically so that different or moving text and/or images and/or graphics may be displayed. This requires the lamps to be switched on and off sequentially. AC switches that can be operated in the range of 900 to 1,500 are difficult and expensive to make. For this reason, it is desirable to employ transformers as shown in FIG. 11*a*, so that the switches 1103 need not be operated at such high voltages. In reference to FIG. 11*a*, the DC/AC converters 1102 may supply AC output voltages below 100 volts and at a frequency of tens of kHz. Preferably, converters 1102 supply AC voltages in the range of 20 to 40 volts or more preferably, in the range of 24 to 36 volts, and at frequencies in the range of 30 to 50 kHz. Switches 1103 are therefore operated within such low voltage range. When a switch 1103 causes the appropriate AC voltage to be applied to its corresponding transformer 1104, the corresponding transformer will step up the voltage to within the 900 to 1,500 volt range for starting or sustaining light emission by the CCFL 1101.

FIGS. 11(*c*), 11(*d*) and 11(*e*) are three schematic circuit diagrams to illustrate three additional embodiments of a driving circuit of CCFLs lamps in a CFD. As shown in FIG. 11(*c*), the DC/AC converter 1122 applies a low voltage at under 100 volts at a frequency of tens of kHz across two sets of electrically conductive lines 1119. As shown in FIG. 11(*c*), converter 1122 includes a transformer 1122*a* with a secondary coil 1122*a*(*s*) which supplies the AC low voltage to two lines of conductors 1119, which in turn supply such voltage to the anodes of the pairs of diodes 1128, each pair of diodes for controlling a corresponding transformer 1124 and a corresponding CCFL 1121. An intermediate point of the secondary coil 1122*a*(*s*) is connected to ground as shown in FIG. 11(*c*). The cathodes of each pair of diodes 1128 are connected to an intermediate point 1127*a* of the primary coil 1127 of the corresponding transformer 1124 for supplying power to the corresponding CCFL 1121 through a capacitor 1125.

The output voltage of converter 1122 appears across the ends of secondary coil 1122*a*(*s*). Since the output voltage of the converter is an AC voltage, the polarity of the voltage will change periodically at a frequency of tens of kHz. Preferably, such AC output voltage is at a frequency within the range of 30 to 50 kHz. Since the two ends of coil 1122*a*(*s*) are connected to the anodes of each pair of diodes, the output voltage will be applied to the primary coil 1127 irrespective of the polarity of the AC output voltage of converter 1122. To complete the circuit, an intermediate point 1127*a* of the primary coil 1127 is connected by means of an electrical conductor 1129 to ground through a corresponding switch 1123. It will be noted that, irrespective of the polarity of the output voltage of converter 1122, the current will flow through one section of the primary coil 1127, then from the intermediate point 1127*a* through conductor 1129, switch 1123 to ground. For this reason, switch 1123 may be a DC switch, instead of an AC switch, which further reduces the cost of providing such switches for operating the display. The voltage across the primary coil 1127 is of the order of the output voltage of converter 1122. Such voltage is stepped up by transformer 1124 to a voltage within the operating range of voltages of CCFLs.

While in the embodiments of FIGS. 11(*c*)–11(*e*) are shown with the anodes of the pairs of diodes connected to the outputs of the converters 1122, it will be understood that this is not required. Thus, the two diodes in each of the pairs of diodes may both be placed with reversed polarity so that their cathodes are connected to converter 1122, and their anodes to points 1127*a*, which are then connected to a reference voltage higher than ground through switch 1123; such and other variations are within the scope of the invention.

In the embodiment of FIG. 11(*c*), each of the transformer circuits for powering a corresponding CCFL has its corresponding pair of diodes 1128. In such embodiment, the corresponding set of diodes will need to handle only the current necessary for operating its corresponding CCFL. Such embodiment will be desirable where the conductors 1119 are used for addressing and controlling a large number of CCFLs arranged in a row. Where the two conductors are used to operate a small number of CCFLs, it may be adequate for all the CCFLs connected to the pair of conductors to share a common pair of diodes 1128*a* as shown in FIG. 11(*d*). Thus, as shown in FIG. 11(*d*), only a single pair of diodes 1128*a* is employed, for supplying power to the two conductors 1119*a* that are used for supplying power to a number of CCFLs.

Instead of placing the diodes in the circuit path between the converter 1122 and the primary coil 1127, it is also possible to place the pair of diodes between the primary coil in the transformer 1124 and its corresponding switch, as shown in FIG. 11(*e*). As shown in such figure, the primary coil 1127*b* has two sections 1127*b*(1) and 1127*b*(2). Each of the two sections of the primary coil are connected at one end to one of the two conductors 1119 and, at the other end, through a corresponding diode of the pair of diodes 1128*b*, conductor 1129 and switch 1123 to ground. Thus, in general, the diodes in the pair of diodes may be placed at any point, symmetrically or otherwise, in the circuit path from the output terminals of the converter 1122 through the primary coil of a transformer and its corresponding switch to ground. Obviously, switch 1123 and the intermediate points of coil 1122*a*(*s*) in converters 1122 may be connected to a reference voltage other than ground; such and other variations are within the scope of the invention. Where converters 1122 are powered by an AC source, such as power at 110 volts, at 60 Hz, from power companies, such converters may also include rectifiers (not shown) to first convert such power to DC power before such DC power is converted further to the low voltage high frequency power delivered by the converters.

While the invention has been described above by reference to various embodiments, it will be understood that changes and modifications may be made without departing from the scope of the invention, which is to be defined only by the appended claims and their equivalents.

What is claimed is:

1. A cold cathode fluorescent display device, comprising:

a plurality of individually controllable cold cathode fluorescent lamps; and a circuit applying operating voltages to the lamps to control time periods during which the lamps fluoresce to display a character, graphics or a video image, said plurality of individually controllable cold cathode fluorescent lamps arranged in a two dimensional array having rows and columns, said display further comprising a first set of electrically conductive lines addressing rows of the lamps, and a second set of electrically conductive lines addressing columns of the lamps, said circuit applying said operating voltages to the two sets of lines.

2. The device of claim 1, wherein each of the electrically conductive lines in the first set addresses a row of the lamps, and each of the electrically conductive lines in the second set addresses a column of the lamps.

3. The device of claim 1, said circuit including a plurality of DC/AC converters each connected to a line in the first set, and a plurality of switches each connecting a corresponding cold cathode fluorescent lamp to a line in the first set and a line in the second set.

4. The device of claim 3, said circuit causing said converters to supply operating voltages in the range of several to tens of volts and tens of kHz in frequency.

5. The device of claim 4, said circuit causing the converters to supply operating voltages in the range of about 20 to 40 volts.

6. The device of claim 4, said plurality of switches being AC switches suitable for switching voltages in the ranges of several to tens of volts and tens of kHz in frequency.

7. The device of claim 4, further comprising a plurality of transformers converting the operating voltages to higher AC voltages for starting and sustaining light emission by the lamps.

8. The device of claim 7, said plurality of transformers converting the operating voltages to AC voltages in the range of 900 to 1500 volts.

9. The device of claim 1, said circuit comprising DC/AC converters which provide AC output voltages, and a plurality of transformer circuits converting the AC output voltages from the converters to higher AC voltage signals for starting the lamps, said transformers providing sustaining voltages in response to the AC output voltages after the lamps are started to sustain light emission by the lamps, said sustaining voltages being of smaller amplitudes than the higher AC voltage signals for starting the lamps.

10. The device of claim 9, wherein at least one of the transformer circuits includes a primary coil and a secondary coil, a DC switch connecting an intermediate point of the primary coil to a reference voltage, and two diodes in a circuit path connecting the AC output voltages from one of the converters to the primary coil and to the reference voltage.

11. The device of claim 10, wherein the two diodes connect the AC output voltages from said one converter to the primary coil.

12. The device of claim 11, wherein the two diodes are so connected to the converters and the secondary coil that the AC output voltages are applied to the secondary coil irrespective of the polarity of the AC output voltages.

13. The device of claim 12, wherein the two diodes are so connected to the converters and the secondary coil that their anodes or their cathodes receive the AC output voltages or voltages derived therefrom.

14. The device of claim 10, wherein the two diodes of each of the transformer circuits connect the intermediate point of the primary coil of such transformer to the reference voltage.

15. The device of claim 9, wherein at least some of the lamps are arranged in a row, wherein each of the transformer circuits for applying voltages to the row of the lamps includes a primary coil and a secondary coil, a DC switch connecting an intermediate point of the primary coil to a reference voltage, and wherein said device further comprises two diodes connecting the AC output voltages from one of the converters to the primary coils of all of the transformer circuits applying voltages to the row of the lamps.

16. The device of claim 1, further comprising one or more reflectors adjacent to the lamps to reflect and forward light emitted from the lamps to a viewer and to increase luminance of the display.

17. The device of claim 16, wherein said one or more reflectors includes a high reflectance thin film or a high reflectance diffusing wall.

18. The device of claim 16, wherein said one or more reflectors includes a thin alloy film or a white paint, said film including silver or aluminum.

19. The device of claim 1, further comprising means for controlling temperature of the lamps.

20. The device of claim 19, said temperature controlling means controlling the temperatures of the lamps to within a range of 30 to 75 degrees Celsius.

21. The device of claim 19, said temperature controlling means comprising a heating element, a temperature sensor, an automatic control circuit and a heat conductive plate.

22. The device of claim 21, said heating element comprising an electrical heating wire or film, said heat conductive plate including Al or an alloy, wherein the heating element is seated on the heat conductive plate to keep the lamps at the same temperature.

23. The device of claim 19, further comprising a base plate, and heat insulation means between said temperature control means and the base plate to decrease power consumption of said temperature control means.

24. The device of claim 23, wherein said base plate is black to absorb ambient incident light and to increase the contrast of displayed image.

25. The device of claim 1, further comprising a luminance and contrast enhancement face plate absorbing ambient incident light, focusing and forwarding light emitted from the lamps to a viewer and increasing the luminance of display images.

26. The device of claim 25, wherein said luminance and contrast enhancement face plate comprises optics to focus and forward the light from the lamps to the viewer and to increase the luminance of display images.

27. The device of claim 26, wherein said optics changes direction of light emitted from the lamps so as to forward said light to the viewer.

28. The device of claim 27, wherein said optics has an optical axis along a direction towards the viewer.

29. The device of claim 26, wherein said focus means comprises a series of cylinder lenses or a lens array.

30. The device of claim 26, further comprising some small shades adjacent the optics to absorb the ambient incident light and to increase the contrast of display image.

31. The device of claim 30, wherein said shades are black and non-reflective and are located around said focus means to absorb the ambient incident light, and to increase contrast of display image.

32. The device of claim 1, further comprising one or more shades around the lamps to absorb ambient incident light and to enhance the contrast of displayed images.

33. The device of claim 1, wherein said lamps include white or monochromic lamps to display a white/black or monochromic character, graphics or image.

34. The device of claim 1, wherein said lamps include different color lamps to display multi-color character, graphics or image.

35. The device of claim 1, wherein said lamps comprise red, green, and blue lamps.

36. The device of claim 35, wherein the lamps are distributed in groups of one or more red, green, blue lamps, said applying means applying voltages to said groups of lamps to display a full-color character, graphics or video image.

37. The device of claim 35, further comprising red, green and blue filters to absorb variegated light emitted from gas discharge of the lamps to increase purity of colors and improve quality of color image displayed while increasing contrast by absorbing the ambient incident light.

38. The device of claim 35, wherein said lamps are made of red, green or blue color glass tubes.

39. The device of claim 1, wherein said lamps are "U" shaped, or have a serpentine or circular shape.

40. The device of claim 1, further comprising a plurality of base plates wherein said lamps are distributed over said base plates, the lamps over each base plate forming a small display screen, wherein the lamps over said plurality of base plates form a mosaic large screen or ultra-large screen display.

41. The device of claim 1, further comprising a glass tube defining a vacuum chamber therein housing said plurality of cold cathode fluorescent lamps so as to reduce heat loss, to increase the luminous efficiency and to eliminate the effect of the ambient temperature on the cold cathode fluorescent lamps.

42. A display method for a cold cathode fluorescent display device, said device comprising a plurality of individually controllable cold cathode fluorescent lamps; said method comprising:

applying operating electrical signals to the lamps to control time periods during which the lamps fluoresce to display a character, graphics or a video image, said plurality of individually controllable cold cathode fluorescent lamps arranged in a two dimensional array having rows and columns, said device further comprising a first set of electrically conductive lines connected to rows of the lamps, and a second set of electrically conductive lines connected to columns of the lamps, wherein said applying applies said signals to the two sets of lines to address each of the lamps at the intersection of each line in the first set with each line in the second set.

43. The method of claim 42, wherein said applying applies scanning signals to the first set of lines and data signals to the second set of lines.

44. The method of claim 43, wherein the data and scanning signals are such that they cause one or more starting signals to be applied across at least some of the lamps selected along each of the rows for starting the selected lamps, wherein the data and scanning signals are such that sustaining signals are applied to the two sets of electrodes, and wherein said sustaining signals are adequate to sustain light emission of lamps that have been caused to emit light by the starting signals, but inadequate to cause the lamps that have not been caused to emit light by the starting signals to commence light emission.

45. The method of claim 42, wherein said applying applies one or more starting AC voltage signals for starting the lamps, and sustaining voltages to the lamps after the lamps are started to sustain light emission by the lamps, said sustaining voltages being of smaller amplitudes than the starting voltage signals.

46. The method of claim 42, further comprising converting an input DC high voltage and high frequency signal to serve as an operating voltage signal.

47. A display device, comprising:

a plurality of individually controllable lamps; and a circuit applying operating voltages to the lamps to control time periods during which the lamps fluoresce to display a character, graphics or a video image, said circuit including:

a power source providing AC output voltages;

a plurality of transformer circuits, each of said circuits transforming said AC output voltages to control a corresponding lamp, each of said circuits including a primary coil and a secondary coil, and a DC switch connecting an intermediate point of the primary coil to a reference voltage; and two diodes in a circuit path connecting the AC output voltages to the primary coil of at least one transformer circuit and to the reference voltage.

48. The device of claim 47, wherein the two diodes are so connected to the primary coil that the AC output voltages are applied to the primary coil irrespective of the polarity of the AC output voltages.

49. The device of claim 47, wherein the two diodes are so connected in the circuit path that their anodes or their cathodes receive the AC output voltages or voltages derived therefrom.

50. The device of claim 47, wherein the two diodes connect the AC output voltages from the source to the primary coil.

51. The device of claim 47, wherein the two diodes of each of the transformer circuits connect the intermediate point of the primary coil of such transformer to the reference voltage.

52. The device of claim 47, wherein at least some of the lamps are arranged in a row, wherein the two diodes connect the AC output voltages from the source to the primary coils of all the transformer circuits for applying voltages to the row of the lamps.

53. A cold cathode fluorescent display device, comprising:

a plurality of individually controllable cold cathode fluorescent lamps arranged in a two dimensional array having rows and columns;

a first set of electrically conductive lines each addressing a row of the lamps, and a second set of electrically conductive lines each addressing a column of the lamps; and a circuit applying operating voltages to the lamps through the two sets of lines, causing the lamps fluoresce, in order to display a character, graphics or a video image.

54. A display method for a cold cathode fluorescent display device, said device comprising a plurality of individually controllable cold cathode fluorescent lamps arranged in a two dimensional array having rows and columns, and a first set of electrically conductive lines each addressing a row of the lamps, and a second set of electrically conductive lines each addressing a column of the lamps; said method comprising:

applying operating voltages to the lamps through the two sets of lines, causing the lamps fluoresce, in order to display a character, graphics or a video image.

* * * * *